US005829501A

United States Patent [19]

DeVito

[11] Patent Number: 5,829,501

[45] Date of Patent: Nov. 3, 1998

[54] COMPLETE WORKSTATION

[76] Inventor: Joseph A. DeVito, 2141 Willow St., Wantagh, N.Y. 11793

[21] Appl. No.: 794,184

[22] Filed: Feb. 3, 1997

[51] Int. Cl.[6] ..... B27M 1/00

[52] U.S. Cl. ..... 144/286.1; 108/35; 108/92; 108/96; 108/99; 108/162; 144/286.5; 144/287; 269/901

[58] Field of Search ..... 108/34, 35, 12, 108/28, 92, 93, 96, 99, 162, 179; 144/285, 286.1, 286.5, 287; 53/574; 269/901, 907; 312/258, 277

[56] References Cited

U.S. PATENT DOCUMENTS

| | | | |
|---|---|---|---|
| D. 349,817 | 8/1994 | Scott et al. . | |
| 1,272,151 | 7/1918 | Torp | 144/286.1 |
| 1,381,682 | 6/1921 | Webster et al. | 144/285 |
| 1,385,046 | 7/1921 | Hardy | 144/285 |
| 2,725,619 | 12/1955 | Miller | 144/286.1 |
| 2,962,293 | 11/1960 | Malami | 144/286.1 |
| 4,155,386 | 5/1979 | Alessio . | |
| 4,231,453 | 11/1980 | Minor . | |
| 4,555,099 | 11/1985 | Hilton | 269/901 |
| 4,561,336 | 12/1985 | Davis . | |
| 4,564,181 | 1/1986 | Gansel et al. | 269/901 |
| 4,659,154 | 4/1987 | Jenkins . | |
| 4,875,513 | 10/1989 | Skarsten . | |
| 4,909,495 | 3/1990 | Neuenschwander et al. . | |
| 4,969,496 | 11/1990 | Romans . | |
| 5,161,590 | 11/1992 | Otto . | |
| 5,329,979 | 7/1994 | Miller et al. | 144/286.1 |
| 5,383,977 | 1/1995 | Pierce . | |

*Primary Examiner*—W. Donald Bray
*Attorney, Agent, or Firm*—Michael I. Kroll

[57] ABSTRACT

A complete workstation (10) comprising a workbench (12) and a worktable (14). A facility (16) is for supporting the worktable (14) upon the workbench (12), so that a person (18) can utilize the workbench (12) and the worktable (14) simultaneously.

21 Claims, 3 Drawing Sheets

Fig. 3
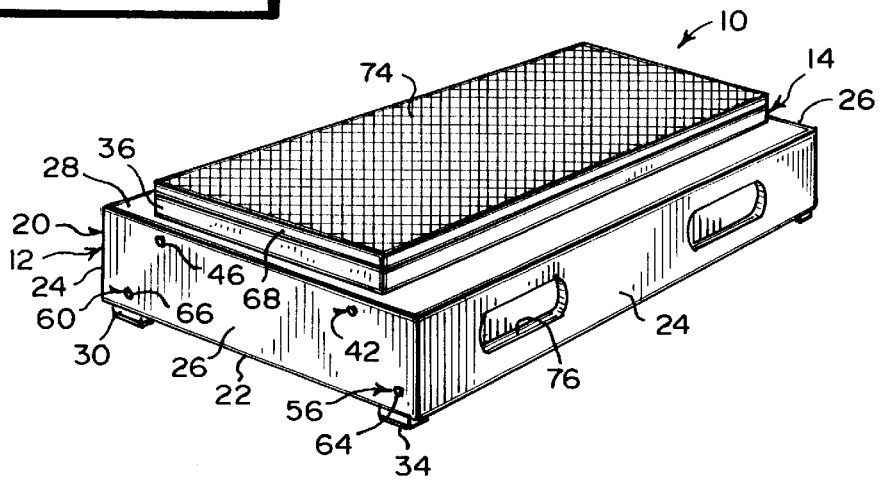
Fig. 4
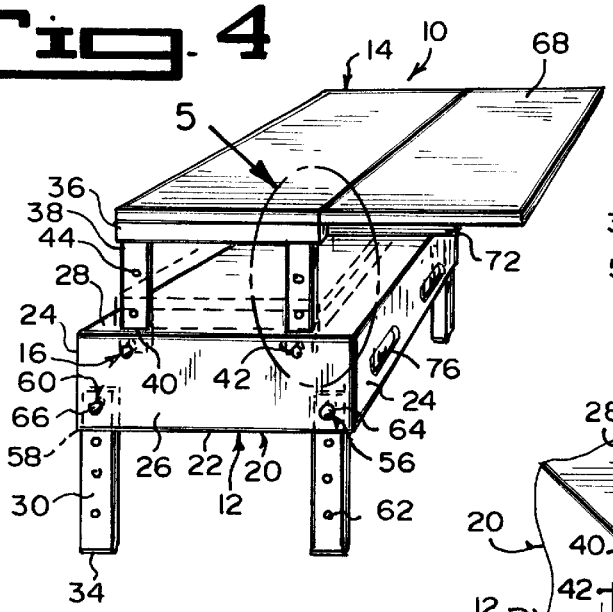
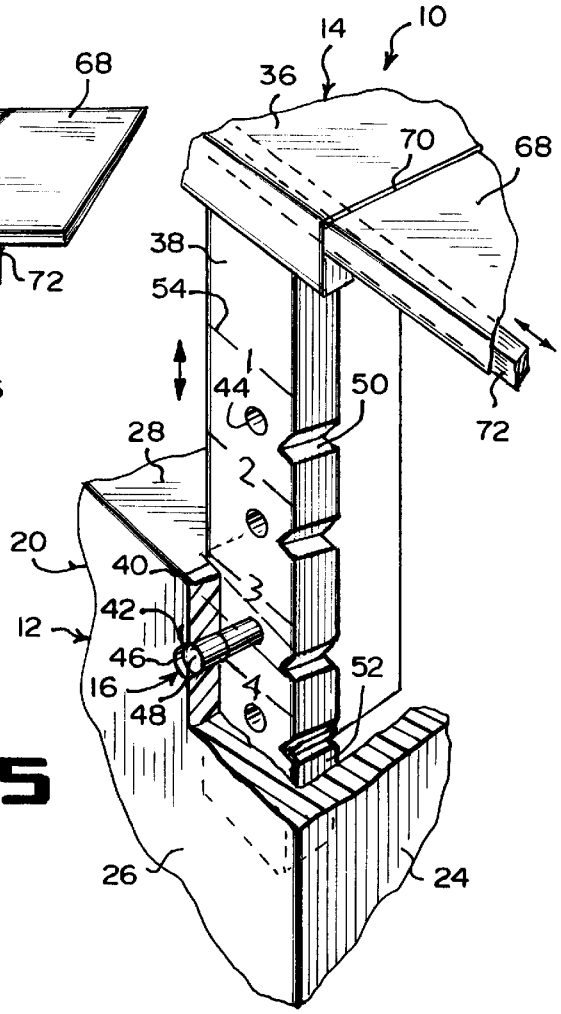
Fig. 5

COMPLETE WORKSTATION

BACKGROUND OF THE INVENTION

1. Field of the Invention

The instant invention relates generally to workbenches and more specifically it relates to a complete workstation. The workstation offers a person a variety of options, so as to allow the person to do the total job at one time.

2. Description of the Prior Art

Numerous workbenches have been provided in prior art. For example, U.S. Pat. Nos. 4,155,386 to Allessio; 4,231,453 to Minor; 4,561,336 to Davis; 4,659,154 to Jenkins; 4,875,513 to Skarsten; 4,909,495 to Neuenschwander et al.; 4,969,496 to Romans; 5,161,590 to Otto; 5,383,977 to Pearce and Des. 349,817 to Scott, Jr. et al., all are illustrative of such prior art. While these units may be suitable for the particular purpose to which they address, they would not be as suitable for the purposes of the present invention as heretofore described.

Alessio, Lorenzo E.

FOLDABLE WORKBENCH

U.S. Pat. No. 4,155,386

The invention is directed to a foldable, portable workbench having a worktable and a support structure for supporting the worktable. The support structure includes a pair of mutually spaced leg assemblies and each of these leg assemblies, in turn, includes a pair of legs pivotally connected at one end thereof to the work table. Articulated linkages pivotally interconnect respectively, the two legs of each pair of legs to each other and at least one of the legs to the worktable. The articulating linkages are connected so that the work table and leg structures are stacked in juxtaposition to each other when the workbench is in its folded position and, so that the other ends of the leg structures are spread apart from each other with the worktable substantially transverse to the leg structures when the workbench is in the erected position.

Minor, William F.

COMBINED BOX, TABLE AND BENCH

U.S. Pat. No. 4,231,453

A box is designed in a size and shape which is convenient for holding any suitable equipment, such as camping and picnicing equipment and including such things as a tent and perhaps some simple cooking implements. The box has six panels which fit together in one manner to form a box and in another manner to form a table, which might be a picnic table, a bench and two spools, for example. When the panels are assembled in yet another manner, they form a compact luggage-type unit for easy carrying. A feature of the invention is that all parts are reusable and that the various configurations fit into preexisting geometrical constraints such as the trunks of cars, and the like.

Davis, Harold E.

PORTABLE UNIVERSAL POWER MITER SAW WORKBENCH

U.S. Pat. No. 4,561,336

A portable workbench is constructed so as to accept miter saws of any size in a simple and convenient manner. The workbench comprises a power tool supporting site and a workpiece supporting surface wherein the power tool supporting site and workpiece supporting surface are adjustable in a substantially vertical direction relative to each other. The power tool supporting site and workpiece supporting surface are each constructed of two frames which are adjustable in a substantially horizontal direction, so as to accept any size miter saw on the power tool supporting site.

Jenkins, Jimmy R.

COMBINED HOBBY CABINET AND WORKBENCH

U.S. Pat. No. 4,659,154

A combination universal hobby cabinet system, including a workbench, wherein the cooperative combination includes an organized storage cabinet having one member that is completely removable from the cabinet and then becomes a workbench which may be set on top of the closed cabinet or other flat surface, to become a work station. the interior of the cabinet uniquely provides stowage space for materials and tools and for the workbench, all for use in the practice of particular hobbies. One embodiment of which system encompasses the hobby of fly-tying to create fishing lures.

Skarsten, Stephen R.

PORTABLE WORKBENCH

U.S. Pat. No. 4,875,513

A portable workbench has two wooden bench top parts mounted on a collapsible support frame. One bench top part has an opening normally covered by a wooden cover plate. To convert the bench into a power tool bench, the cover plate is replaced by an insert plate having a power tool (such as a circular saw) bolted beneath it. The cutting element of the power tool projects through an opening in the insert plate to cut a workpiece supported on the bench top.

Neuenschwander, Charles H., Hopkins, William P., Petersen, David A.

WORKBENCH

U.S. Pat. No. 4,909,495

A workbench capable of clamping workpieces of various thicknesses. The workbench includes a laterally disposed worktable mounted on a support structure. A clamping member is provided which includes a clamp positioned above the worktable and configured to clamp a workpiece between the clamp and the worktable. The workbench further includes a foot treadle pivotally mounted on the support structure. A linkage interconnects the foot treadle with the clamping member, such that rotation of the foot treadle in a first direction moves the clamp into clamping relation with the worktable, and rotation of the foot treadle in a second direction moves the clamp away from the worktable.

Romans, Dennis R.

COMBINATION ELECTRIC TABLE SAW AND FOLDING, MOBILE WORKBENCH

U.S. Pat. No. 4,969,496

The invention relates to workbenches or the like, for supporting machine tools or other heavy equipment, and more specifically to folding, mobile workbenches. The invention is a combination electric table saw and folding, mobile workbench. When unfolded, the invention consists of a rugged horizontal workbench structure held at working height by four, vertically oriented, heavy duty legs. Two of the these legs are mounted upon small wheels and in conjunction with two accessory handles which mount on the opposite side from said wheels, one side of the invention can be easily lifted and the invention moved on said wheels for positioning at the workplace. Each unfolded leg is locked into position by a pivoted dog controlled by an external handle. The legs are capable of being folded and stored within the bench frame structure. When folded, the invention may be moved easily by rolling upon a second pair of wheels attached to said bench frame structure. For storage, the invention is set with the bench frame in the vertical orientation, thereby requiring a minimum of floor space.

Otto, David L.

MITTER SAW TABLE APPARATUS

U.S. Pat. No. 5,161,590

A saw table including a housing cabinet mounting a miter saw, with the mounting platform longitudinally aligned relative to the housing cabinet. A top surface of the mounting platform is positioned below a top surface of the housing cabinet. The mounting of a miter saw table thereto provides planar alignment of the top surface of the miter saw table relative to the top wall of the housing cabinet. The housing cabinet is further provided with a plurality of compartments for the storage of various components associated with the sawing procedure. The mounting platform is provided with a rear abutment flange cooperative with forward clamp legs to secure the miter saw table relative to the mounting platform.

Pearce, Phillip W.

WORKBENCH AND WORKTABLE

U.S. Pat. No. 5,383,977

A workbench comprises a work surface disposed on a supporting structure. The work surface comprises a vice jaw member carrying a first vice jaw and a worktable, having a second complimentary vice jaw. The worktable, in a working position thereof, lies in the same plane as the jaw member, and the jaws face one another and are adapted to be moved towards and away from one another by vice operating means. The worktable is pivotally mounted with respect to the supporting structure about an axis lying adjacent the back edge of the worktable, thereby enabling the worktable to be pivoted away from the supporting structure, to give access to the underside of the worktable. The underside is provided with means for mounting at least one power tool thereon, and has several tool apertures through which working parts of the power tools can project to the upper side of the worktable for working on a workpiece presented to it, when the worktable is returned to the working position. The vice operating means enables asymmetric separation between the vice jaws.

Scott, Jr., Harry W., Britt, Randall W., Renfroe, Kenneth L.

COMBINED BENCH AND STORAGE BOX

U.S. Pat. No. Des. 349,817

The ornamental design for a combined bench and storage box, as shown and described.

FIG. 3 is a side elevational view thereof;

FIG. 4 is an elevational view showing the underside thereof; and

FIG. 5 is an elevational view in line with one of the corners of the combined bench and storage box.

SUMMARY OF THE INVENTION

Figure 1:
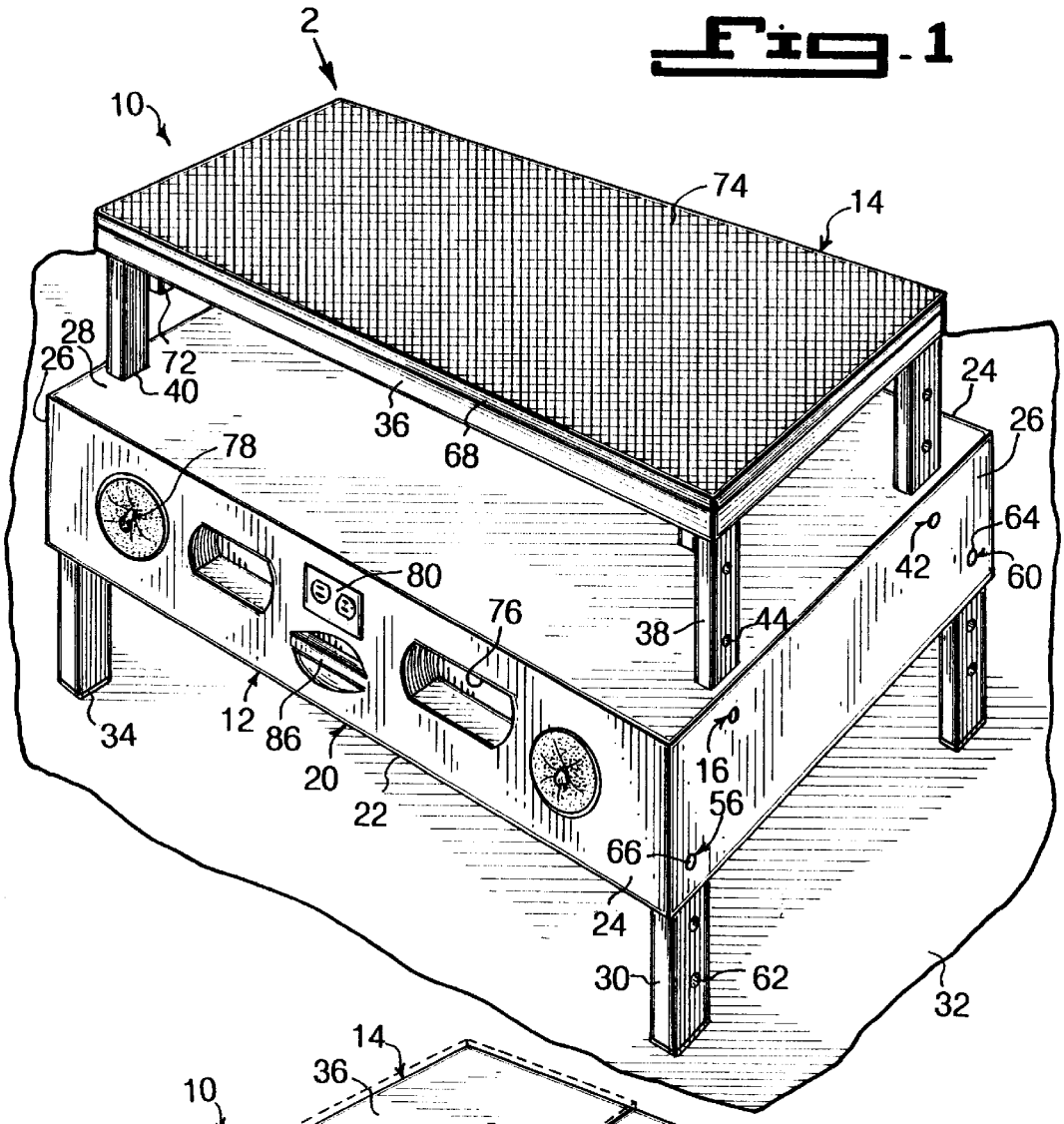
FIG. 1 is an isometric view showing the combined bench and storage box.

A primary object of the present invention is to provide a complete workstation that will overcome the shortcomings of the prior art devices.

Another object is to provide a complete workstation that offers a person a variety of options, such as an adjustable bench, a work surface, extension cords, duplex receptacles with a circuit breaker and a lighted on/off switch, to allow the person to do the total job at one time.

An additional object is to provide a complete workstation that is lightweight, but heavy-duty and durable, so that it can be easily carried by one person.

A further object is to provide a complete workstation that is simple and easy to use.

A still further object is to provide a complete workstation that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view of the instant invention shown in an operable position.

Figure 2:
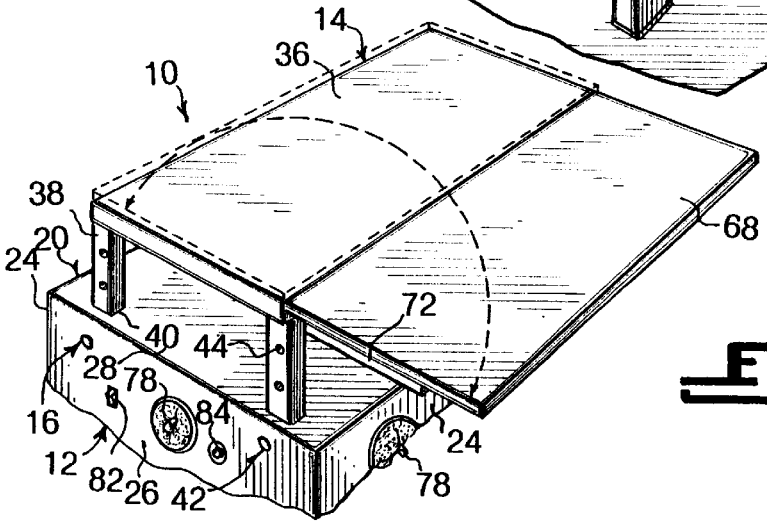
FIG. 2 is a top plan view thereof.

FIG. 2 is a rear perspective view taken in the direction of arrow 2 in FIG. 1, with parts broken away and the top being opened for an additional work surface.

FIG. 3 is a rear perspective view of the instant invention shown in a stored position.

FIG. 4 is a rear perspective view with the top opened for the additional work surface.

FIG. 5 is an enlarged perspective view of the area in FIG. 4 indicated by arrow 5, with parts broken away and in section.

Figures 6, 7:
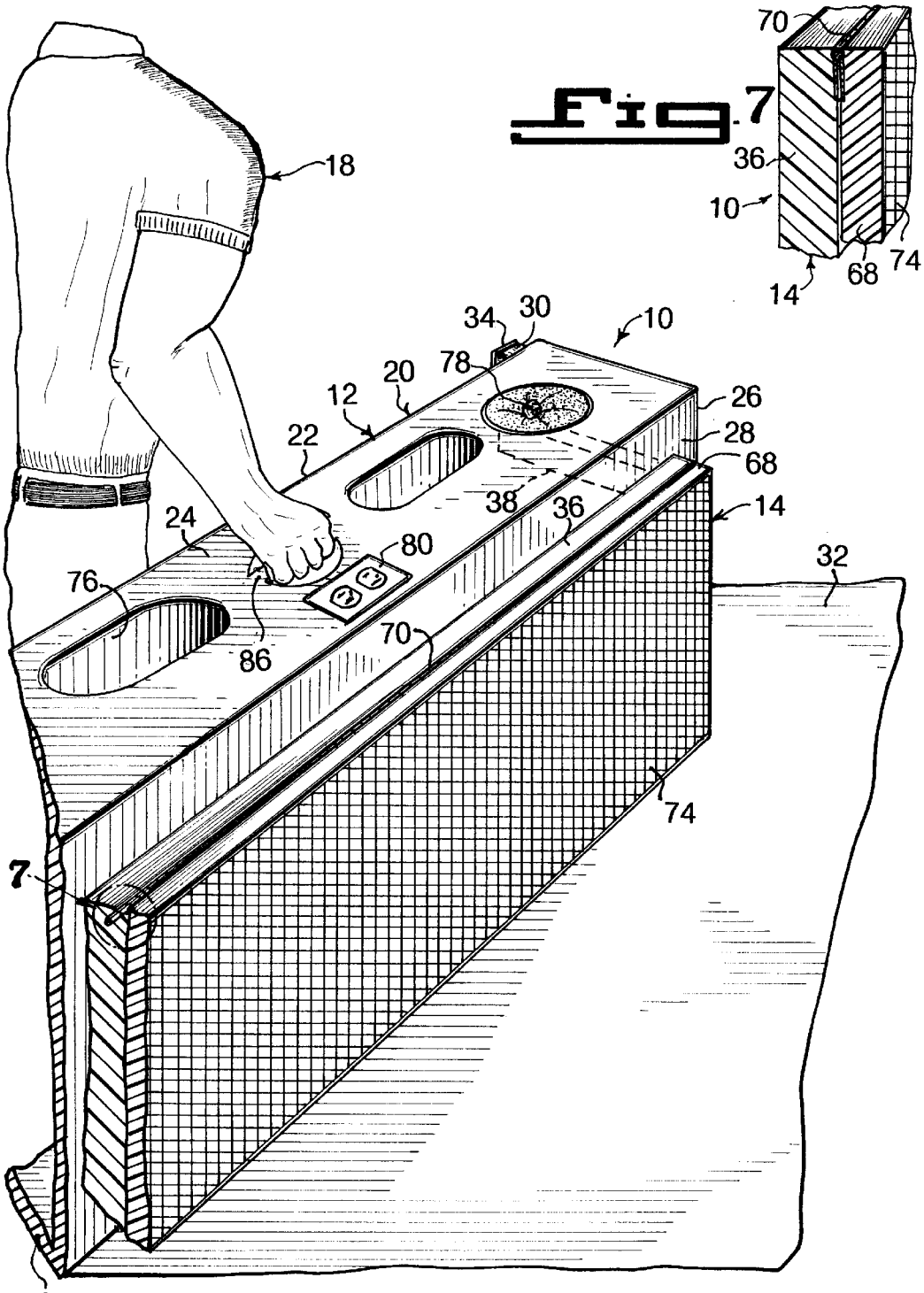

FIG. 6 is a perspective view with parts broken away and in section, showing the instant invention in the stored position and ready to be carried by a person.

FIG. 7 is an enlarged perspective view of the area in FIG. 6 indicated by arrow 7, showing the hinge in greater detail.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 7 illustrate a complete workstation 10 comprising a workbench 12 and a worktable 14. A facility 16 is for supporting the worktable 14 upon the workbench 12, so that a person 18 can utilize the workbench 12 and the worktable 14 simultaneously.

The workbench 12 includes a rectangular hollow work shelf 20 having a bottom panel 22, a pair of side panels 24, a pair of end panels 26 and a top panel 28. A plurality of legs 30 extend downwardly from corners of the bottom panel 22 of the rectangular hollow work shelf 20. The legs 30 will elevate the rectangular hollow work shelf 30 above a floor 32. A plurality of rubber feet 34 are provided. Each rubber foot 34 is on a bottom end of each leg 30, to stabilize the legs 30 upon the floor 32.

The worktable 14 consists of a rectangular top 36. A plurality of legs 38 extend downwardly from the rectangular top 36. The legs 38 will elevate the rectangular top 36 above the top panel 28 of the rectangular hollow work shelf 20.

The supporting facility 16 comprises the top panel 28 of the rectangular hollow work shelf 20, having a plurality of apertures 40 therethrough adjacent corners thereof. Each aperture 40 will receive one leg 38 of the worktable 14. An assembly 42 is for locking each leg 38 of the worktable 14 in an adjustable manner within each aperture 40 in the top panel 28 of the rectangular hollow work shelf 20, so that the height of the worktable 14 can be adjusted with respect to the workbench 12.

The locking assembly 42 includes each leg 38 of the worktable 14 having a plurality of longitudinal spaced apart holes 44 therethrough. Each end panel 26 of the rectangular hollow work shelf 20 has two bores 46 therethrough directly below two of the apertures 40 in the to panel 28. A plurality of lock buttons 48 are provided. Each lock button 48, as best seen in FIG. 5, extends through one bore 46 and into one hole 44 in one leg 38 of the worktable 14 when manually depressed.

Each leg 38 of the worktable 14 can have a plurality of side notches 50 being in alignment with each hole 44. A plurality of V-shaped spring clips 52 can also be provided. Each V-shaped spring clip 52 is carried within one aperture 40 in the top panel 28, to engage with one side notch 50 on one leg 38 of the worktable 14, to be held at that position until the respective lock button 48 is engaged. A plurality of scale settings 54 are placed upon each leg 38 of the worktable 14, so as to be utilized in adjusting and locking each leg 38 of the worktable 14 imposition.

A structure 56 is for adjusting the height of the legs 30 of the workbench 12 with respect to the bottom panel 22 of the rectangular hollow work shelf 20. The adjusting structure 56 includes the bottom panel 22 of the rectangular hollow work shelf 20 having a plurality of apertures 58 therethrough adjacent corners thereof. Each aperture 58 will receive one leg 30 of the workbench 12. An assemblage 60 is for locking each leg 30 of the workbench 12 in an adjustable manner within each aperture 58 in the bottom panel 22 of the rectangular hollow work shelf 20, so that the height of the workbench 12 can be adjusted with respect to the floor 32.

The locking assemblage 60 consists of each leg 30 of the workbench 12 having a plurality of longitudinal spaced apart holes 62 therethrough. Each end panel 26 of the rectangular hollow work shelf 20 has two bores 64 therethrough directly above two of the apertures 58 in the bottom panel 22. A plurality of lock buttons 66 are provided. Each lock button 66 extends through one bore 64 and into one hole 62 in one leg 30 of the workbench 12 when manually depressed.

The worktable 14 further includes a rectangular leaf 68 being of a size equal to that of the rectangular top 36. A hinge 70 is between one longitudinal edge of the rectangular top 36 and the rectangular leaf 68, so that the rectangular leaf 68 can fold out to an open extended position. A pair of support bars 72 extend in an adjustable manner from under the rectangular top 68 below the hinge 70, to support the rectangular leaf 68 in its open extended position. The rectangular leaf 68 has a non-skid surface 74, so that a person 18 can safely stand upon the rectangular leaf 68, when the rectangular leaf 68 is folded in a closed position upon the rectangular top 36. The side panels 24 have a plurality of recessed ports 76, to allow the person 18 to easily step up onto the non-skid surface 74 on the rectangular leaf 68.

A plurality of retractable power cords 78 are in the side panels 24 and the end panels 26. A plurality of duplex electrical receptacles 80 are in the side panels 24. An on/off switch 82 is in one end panel 24. A circuit breaker 84 is in one end panel 24. The workbench 12 further includes a molded carry handle 86 formed in one side panel 24. When the workbench 12 and the worktable 14 are placed into a collapsed condition, a person 18 can grasp the carry handle 86 for transportation to another location, as shown in FIG. 6.

LIST OF REFERENCE NUMBERS

10 complete workstation
12 workbench of 10
14 worktable of 10
16 supporting facility of 10
18 person
20 rectangular hollow work shelf of 12
22 bottom panel of 20
24 side panel of 20
26 end panel of 20
28 top panel of 20
30 leg of 12
32 floor
34 rubber foot on 30
36 rectangular top of 14
38 leg of 14
40 aperture in 28 of 16
42 locking assembly of 16
44 hole in 38 of 42
46 bore in 26 of 42
48 lock button of 42
50 side notch in 38
52 V-shaped spring clip in 40
54 scale setting on 38
56 adjusting structure for 30
58 aperture in 20 of 56
60 locking assemblage of 56
62 hole in 30 of 60
64 bore in 26 of 60
66 lock button of 60
68 rectangular leaf of 14
70 hinge between 36 and 68
72 support bar of 14
74 non-skid surface on 68
76 recessed port in 24
78 retractable power cord in 24 and 26
80 duplex electrical receptacle in 24
82 on/off switch in 24
84 circuit breaker in 24
86 molded carry handle in 24

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A complete workstation comprising:

a) a workbench having:

i) a rectangular hollow work shelf having a bottom panel, a pair of side panels, a pair of end panels and a top panel;

ii) a plurality of legs extending downwardly from corners of said bottom panel of said rectangular hollow work shelf, so that said legs will elevate said rectangular hollow work shelf above a floor; and iii) a plurality of rubber feet, in which each said rubber foot is on a bottom end of each said leg, to stabilize said legs upon the floor;

b) a worktable having:

i) a rectangular top; and ii) a plurality of legs extending downwardly from said rectangular top, so that said legs will elevate said rectangular top above said top panel of said rectangular hollow work shelf; and c) means for supporting said worktable upon said workbench, so that a person can utilize said workbench and said worktable simultaneously, said supporting means including:

i) said top panel of said rectangular hollow work shelf having a plurality of apertures therethrough adjacent corners thereof, whereby each said aperture will receive one said leg of said worktable; and ii) means for locking each said leg of said worktable in an adjustable manner within each said aperture in said top panel of said rectangular hollow work shelf, so that the height of said worktable can be adjusted with respect to said workbench.

2. A complete workstation as recited in claim 1, wherein said locking means includes:

a) each said leg of said worktable having a plurality of longitudinal spaced apart holes therethrough;

b) each said end panel of said rectangular hollow work shelf having two bores therethrough directly below two of said apertures in said top panel; and c) a plurality of lock buttons, wherein each said lock button extends through one said bore and into one said hole in one said leg of said worktable when manually depressed.

3. A complete workstation as recited in claim 2, wherein said locking means further includes:

a) each said leg of said worktable having a plurality of side notches being in alignment with each said hole; and b) a plurality of V-shaped spring clips, each said V-shaped spring clip carried within one said aperture in said top panel, to engage with one said side notch on one said leg of said worktable, to be held at that position until said respective lock button is engaged.

4. A complete workstation as recited in claim 3, wherein said locking means further includes a plurality of scale settings placed upon each said leg of said worktable, so as to be utilized in adjusting and locking each said leg of said worktable in position.

5. A complete workstation as recited in claim 1, further including means for adjusting the height of said legs of said workbench with respect to said bottom panel of said rectangular hollow work shelf.

6. A complete workstation comprising:

a) a workbench having:

i) a rectangular hollow work shelf having a bottom panel, a pair of side panels, a pair of end panels and a top panel;

ii) a plurality of legs extending downwardly from corners of said bottom panel of said rectangular hollow work shelf, so that said legs will elevate said rectangular hollow work shelf above a floor; and iii) a plurality of rubber feet, in which each said rubber foot is on a bottom end of each said leg, to stabilize said legs upon the floor;

b) a worktable;

c) means for supporting said worktable upon said workbench, so that a person can utilize said workbench and said worktable simultaneously; and d) means for adjusting the height of said legs of said workbench with respect to said bottom panel of said rectangular hollow work shelf, wherein said adjusting means includes:

i) said bottom panel of said rectangular hollow work shelf having a plurality of apertures therethrough adjacent corners thereof, whereby each said aperture will receive one said leg of said workbench; and ii) means for locking each said leg of said workbench in an adjustable manner within each said aperture in said bottom panel of said rectangular hollow work shelf, so that the height of said workbench can be adjusted with respect to the floor.

7. A complete workstation as recited in claim 6, wherein said locking means includes:

a) each said leg of said workbench having a plurality of longitudinal spaced apart holes therethrough;

b) each said end panel of said rectangular hollow work shelf having two bores therethrough directly above two of said apertures in said bottom panel; and c) a plurality of lock buttons, wherein each said lock button extends through one said bore and into one said hole in one said leg of said workbench when manually depressed.

8. A complete workstation comprising:

a) a workbench having:

i) a rectangular hollow work shelf having a bottom panel, a pair of side panels, a pair of end panels and a top panel;

ii) a plurality of legs extending downwardly from corners of said bottom panel of said rectangular hollow work shelf, so that said legs will elevate said rectangular hollow work shelf above a floor; and iii) a plurality of rubber feet, in which each said rubber foot is on a bottom end of each said leg, to stabilize said legs upon the floor;

b) a worktable having:

i) a rectangular top;

ii) a plurality of legs extending downwardly from said rectangular top, so that said legs will elevate said rectangular top above said top panel of said rectangular hollow work shelf;

iii) a rectangular leaf being of a size equal to that of said rectangular top;

iv) a hinge between one longitudinal edge of said rectangular top and said rectangular leaf, so that said rectangular leaf can fold out to an open extended position; and v) a pair of support bars extending in an adjustable manner from under said rectangular top below said hinge to support said rectangular leaf in its open extended position; and c) means for supporting said worktable upon said workbench, so that a person can utilize said workbench and said worktable simultaneously.

9. A complete workstation as recited in claim 8, wherein said worktable further includes:

a) said rectangular leaf having a non-skid surface, so that a person can safely stand upon said rectangular leaf, when said rectangular leaf is folded in a closed position upon said rectangular top; and b) said side panels having a plurality of recessed ports, to allow the person to easily step up onto said non-skid surface on said rectangular leaf.

10. A complete workstation comprising:

a) a workbench having:

i) a rectangular hollow work shelf having a bottom panel, a pair of side panels, a pair of end panels and a top panel;

ii) a plurality of legs extending downwardly from corners of said bottom panel of said rectangular hollow work shelf, so that said legs will elevate said rectangular hollow work shelf above a floor;

iii) a plurality of rubber feet, in which each said rubber foot is on a bottom end of each said leg, to stabilize said legs upon the floor;

iv) a plurality of retractable power cords in said side panels and said end panels;

v) a plurality of duplex electrical receptacles in said side panels;

vi) an on/off switch in one said end panel; and vii) a circuit breaker in one said end panel;

b) a worktable; and c) means for supporting said worktable upon said workbench, so that a person can utilize said workbench and said worktable simultaneously.

11. A complete workstation comprising:

a) a workbench having:

i) a rectangular hollow work shelf having a bottom panel, a pair of side panels, a pair of end panels and a top panel;

ii) a plurality of legs extending downwardly from corners of said bottom panel of said rectangular hollow work shelf, so that said legs will elevate said rectangular hollow work shelf above a floor; and iii) a plurality of rubber feet, in which each said rubber foot is on a bottom end of each said leg, to stabilize said legs upon the floor;

b) a worktable;

c) means for supporting said worktable upon said workbench, so that a person can utilize said workbench and said worktable simultaneously; and d) a molded carry handle formed in one said side panel, so that when said workbench and said worktable are placed into a collapsed condition, a person can grasp said carry handle for transportation to another location.

12. A complete workstation as recited in claim 1, wherein said locking means includes:

a) each said leg of said worktable having a plurality of longitudinal spaced apart holes therethrough;

b) each said end panel of said rectangular hollow work shelf having two bores therethrough directly below two of said apertures in said top panel; and c) a plurality of lock buttons, wherein each said lock button extends through one said bore and into one said hole in one said leg of said worktable when manually depressed.

13. A complete workstation as recited in claim 12, wherein said locking means further includes:

a) each said leg of said worktable having a plurality of side notches being in alignment with each said hole; and b) a plurality of V-shaped spring clips, each said V-shaped spring clip carried within one said aperture in said top panel, to engage with one said side notch on one said leg of said worktable, to be held at that position until said respective lock button is engaged.

14. A complete workstation as recited in claim 13, wherein said locking means further includes a plurality of scale settings placed upon each said leg of said worktable, so as to be utilized in adjusting and locking each said leg of said worktable in position.

15. A complete workstation as recited in claim 14, further including means for adjusting the height of said legs of said workbench with respect to said bottom panel of said rectangular hollow work shelf.

16. A complete workstation as recited in claim 15, wherein said adjusting means includes:

a) said bottom panel of said rectangular hollow work shelf having a plurality of apertures therethrough adjacent corners thereof, whereby each said aperture will receive one said leg of said workbench; and b) means for locking each said leg of said workbench in an adjustable manner within each said aperture in said bottom panel of said rectangular hollow work shelf, so that the height of said workbench can be adjusted with respect to the floor.

17. A complete workstation as recited in claim 16, wherein said locking means includes:

a) each said leg of said workbench having a plurality of longitudinal spaced apart holes therethrough;

b) each said end panel of said rectangular hollow work shelf having two bores therethrough directly above two of said apertures in said bottom panel; and c) a plurality of lock buttons, wherein each said lock button extends through one said bore and into one said hole in one said leg of said workbench when manually depressed.

18. A complete workstation as recited in claim 17, wherein said worktable further includes:

a) a rectangular leaf being of a size equal to that of said rectangular top;

b) a hinge between one longitudinal edge of said rectangular top and said rectangular leaf, so that said rectangular leaf can fold out to an open extended position; and c) a pair of support bars extending in an adjustable manner from under said rectangular top below said hinge to support said rectangular leaf in its open extended position.

19. A complete workstation as recited in claim 18, wherein said worktable further includes:

a) said rectangular leaf having a non-skid surface, so that a person can safely stand upon said rectangular leaf, when said rectangular leaf is folded in a closed position upon said rectangular top; and b) said side panels having a plurality of recessed ports, to allow the person to easily step up onto said non-skid surface on said rectangular leaf.

20. A complete workstation as recited in claim 19, wherein said workbench further includes:

a) a plurality of retractable power cords in said side panels and said end panels;

b) a plurality of duplex electrical receptacles in said side panels;

c) an on/off switch in one said end panel; and d) a circuit breaker in one said end panel.

21. A complete workstation as recited in claim 20, wherein said workbench further includes a molded carry handle formed in one said side panel, so that when said workbench and said worktable are placed into a collapsed condition, a person can grasp said carry handle for transportation to another location.

* * * * *